US006592410B2

(12) United States Patent
Yoshida et al.

(10) Patent No.: US 6,592,410 B2
(45) Date of Patent: Jul. 15, 2003

(54) CIRCUIT FORMING ELEMENT

(75) Inventors: Haruki Yoshida, Shizuoka (JP); Toshiyuki Yamaguchi, Shizuoka (JP); Masaaki Ikegaya, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/075,563

(22) Filed: Feb. 15, 2002

(65) Prior Publication Data

US 2002/0123272 A1 Sep. 5, 2002

(30) Foreign Application Priority Data

Feb. 16, 2001 (JP) ..... P2001-039708

(51) Int. Cl.[7] ..... H01R 13/502

(52) U.S. Cl. ..... 439/701; 439/862; 439/507; 439/721; 439/908

(58) Field of Search ..... 439/701, 862, 439/507, 721, 908, 101, 251, 949, 66, 595

(56) References Cited

U.S. PATENT DOCUMENTS 4,659,158 A * 4/1987 Sakamoto et al. ..... 439/507
5,707,254 A * 1/1998 Chishima et al. ..... 439/507
5,885,090 A * 3/1999 Comstock et al. ..... 439/862

FOREIGN PATENT DOCUMENTS

EP 0 624 936 A2 * 11/1994 ..... 439/701
JP 2-5288 1/1990

* cited by examiner

*Primary Examiner*—Tho D. Ta
(74) *Attorney, Agent, or Firm*—Sughrue Mion, PLLC

(57) ABSTRACT

A bus bar is constituted by integrally forming pairs of terminal contact pieces, each pair of which is in contact with an opposed terminal, a pair of connecting base portions, which integrally connect the base-side portions of the terminal contact pieces arranged on the same side thereof, and connecting pieces for connecting the pair of connecting base portions. This bus bar is integrally coupled to a bus bar fixing member constituted by an insulating member. An arbitrary circuit including so-called a skip connection can be constructed by suitably cutting the connecting base portions and the connecting piece. Thus, the entire circuit forming element is constituted as one component.

8 Claims, 12 Drawing Sheets

CIRCUIT FORMING ELEMENT

CROSS REFERENCE TO RELATED APPLICATION

The present application is based on Japanese Patent Application No. 2001-39708, the entire contents of which are incorporated herein by reference.

BACKGROUND OF THE INVENTION

1. Field of the Invention

The present invention relates to a circuit forming element adapted to intervene among a plurality of terminals and enabled to arbitrarily form a connection circuit between the terminals.

2. Related Art

Conventional circuit forming elements are, for example, elements each applied to a joint connector disclosed in JP-A-2-5288U. As illustrated in FIGS. 12A and 12B, these elements are constituted as relay terminals 1 and 1', each of which comprises a metal piece 1*a*, a connecting piece 1*b*, and an elastic contact piece 1*c*. As illustrated in FIG. 13, terminal metal fittings 4 are electrically conducted to each other by inserting this relay terminal 1 into a cavity of a terminal accommodating chamber 3 of the joint connector 2.

However, the conventional relay terminal 1 is constituted as a single bus bar manufactured by bend-forming a metal plate. A plurality of such relay terminals 1 are used and respectively attached between corresponding ones of the terminal accommodating chambers 3 from the front face of the joint connector 2. Thus, the mountability of the circuit forming elements is poor. Moreover, because a plurality of such relay terminals 1 are individually attached thereto, the tractability thereof is degraded with increase in the number of components thereof.

SUMMARY OF THE INVENTION

The invention is accomplished in view of such problems of the conventional circuit forming elements. An object of the invention is to provide a circuit forming element of the integrated type that is easy to handle and enabled to easily constitute an arbitrary circuit.

According to the invention, there is provided a circuit forming element (hereunder referred to as a fist circuit forming element of the invention), comprising: a bus bar including a plurality of pairs of terminal contact pieces, each pair of which are brought into contact respectively with the terminals opposing with each other provided in the housings adjoining to each other in the stacking direction, a pair of connecting base portions one of which integrally connects proximal ends of the terminal contact pieces disposed at one side while the other connecting base portion integrally connects proximal ends of the terminal contact pieces disposed at the other side, and connecting pieces connecting the pair of connecting base portions; wherein the bus bar is integrally coupled to a bus bar fixing member provided with an insulating member.

In this case, the bus bar is adapted so that each of the paired terminal contact pieces is electrically conducted to the connecting base portion, and that the connecting base portions are electrically conducted to each other through the connecting piece. Therefore, in this state, a terminal contact piece, which is in contact with a specific terminal, is electrically conducted through one of connecting base portions, which is connected to this terminal contact piece, to another terminal contact piece connected to this connecting base portion and is also electrically conducted to another connecting base portion through a connecting piece. Moreover, the terminal contact piece, which is in contact with the specific terminal, is electrically conducted to a pair of terminal contact pieces through this connecting base portion. Consequently, all the terminal contact pieces are electrically conducted to one another. In this state, one or both of a pair of connecting base portions are cut at appropriate places, alternatively, the connecting piece is cut. Thus, an arbitrary circuit including so-called a skip connection can be configured. Further, the bus bar capable of constructing an arbitrary circuit in this way is coupled to the bus bar fixing member, so that the contact state between the bus bar and the terminal can be held without excessively increasing the strength of the bus bar. Thus, the entire circuit forming element is constructed as one component.

According to an embodiment (hereunder referred to as a second circuit forming element of the invention) of the first circuit forming element of the invention, the pair of connecting base portions are offset with respect to each other so that the two connecting base portions do not overlap each other in a plane of projection in a direction of opposing of the connecting base portions to each other.

In this case, when a pair of connecting base portions are cut at appropriate places and cutting blades are inserted from opposed directions thereof, both the connecting base portions are displaced from each other. Thus, the connecting base portions are easy to individually cut.

According to an embodiment (hereunder referred to as a third circuit forming element of the invention) of the first or second circuit forming element of the invention, proximal ends of the terminal contact pieces are integrally connected to the bus bar fixing member.

In this case, each of the terminal contact pieces is fixed to the bus bar fixing member at the proximal end thereof. Thus, the spring forces of the terminal contact pieces are effectively exerted, so that the contact force acting between the terminal contact piece and the terminal is ensured.

According to an embodiment (hereunder referred to as a fourth circuit forming element of the invention) of one of the first to third circuit forming elements of the invention, a coupling between the bus bar and the bus bar fixing member is fixed through an opening formed in the bus bar and a protrusion having a flange portion, which is formed on the bus bar fixing member and fitted into the opening by simultaneously forming a partial gap between the protrusion and an inner circumferential portion of the opening.

In this case, when the flange portion of the protrusion is deformed during the flange portion is fitted into the opening formed in the bus bar, the deformed part gets into the gap. Consequently, an amount cut by the inner circumferential portion of the opening away from the flange portion can be reduced.

According to an embodiment (hereunder referred to as a fifth circuit forming element of the invention) of one of the first to fourth circuit forming elements of the invention, cutting portions are selectively formed on the bus bar in the vicinity of portions where the connecting base portion and the connecting piece are connected together.

In this case, the cutting portions are concentrated by cutting a part provided in the vicinity of the connection portion among the connecting base portions and the connecting pieces so that the connecting base portions and the connecting pieces are selectively cut at the cutting portions. Thus, the management of the electrically conducting relation is facilitated. Moreover, the cutting blades (not shown) for cutting the connecting base portions and the connecting piece can be concentrated to thereby realize a compact circuit forming element.

According to an embodiment (hereunder referred to as a sixth circuit forming element of the invention) of one of the first to fifth circuit forming elements of the invention, a lance for engaging the terminal in a direction to prevent the withdrawal thereof is provided in the terminal accommodating portion for accommodating the terminal, and the bus bar-fixing member has a lance-return regulating portion pressing the lance in a withdrawal prevention direction.

In this case, the lance-return regulating portion pushes the lance in the withdrawal preventing direction by attaching the circuit forming element. This enables the prevention of the return of the lance, that is, the cancellation of the state, in which the lance engages with the terminal.

According to an embodiment (hereunder referred to as a seventh circuit forming element of the invention) of one of the first to sixth circuit forming elements of the invention, a chamfered portion is formed at an opposite side edge of the terminal contact piece brought into contact with the terminal.

In this case, when the terminal contact piece is brought into contact with the terminal with a predetermined pushing force, the terminal can be prevented from being damaged by the side part of the contact portion of the terminal contact piece.

According to an embodiment (hereunder referred to as an eighth circuit forming element of the invention) of one of the first to seventh circuit forming elements of the invention, a U-shaped bending portion to be folded back on a side edge of the bus bar fixing member is provided in each of the connecting pieces, and wherein the U-shaped bending portions are outwardly exposed.

In this case, the U-shaped bending portion of the connecting piece is outwardly exposed. Thus, a measuring terminal of a tester can easily be brought into contact with this exposed part. Consequently, the conducting relation of the bus bar can be easily and reliably checked.

DETAILED DESCRIPTION OF THE PREFERRED EMBODIMENTS

Hereinafter, an embodiment of the invention is described in detail with reference to the accompanying drawings. FIGS. 1 to 11 illustrate an embodiment of a circuit forming element of the invention. The circuit forming element of this embodiment to be applied to a joint connector constituted by superposing housings, on each of which a plurality of terminals are juxtaposed with one another, is described by way of example.

Figure 1:
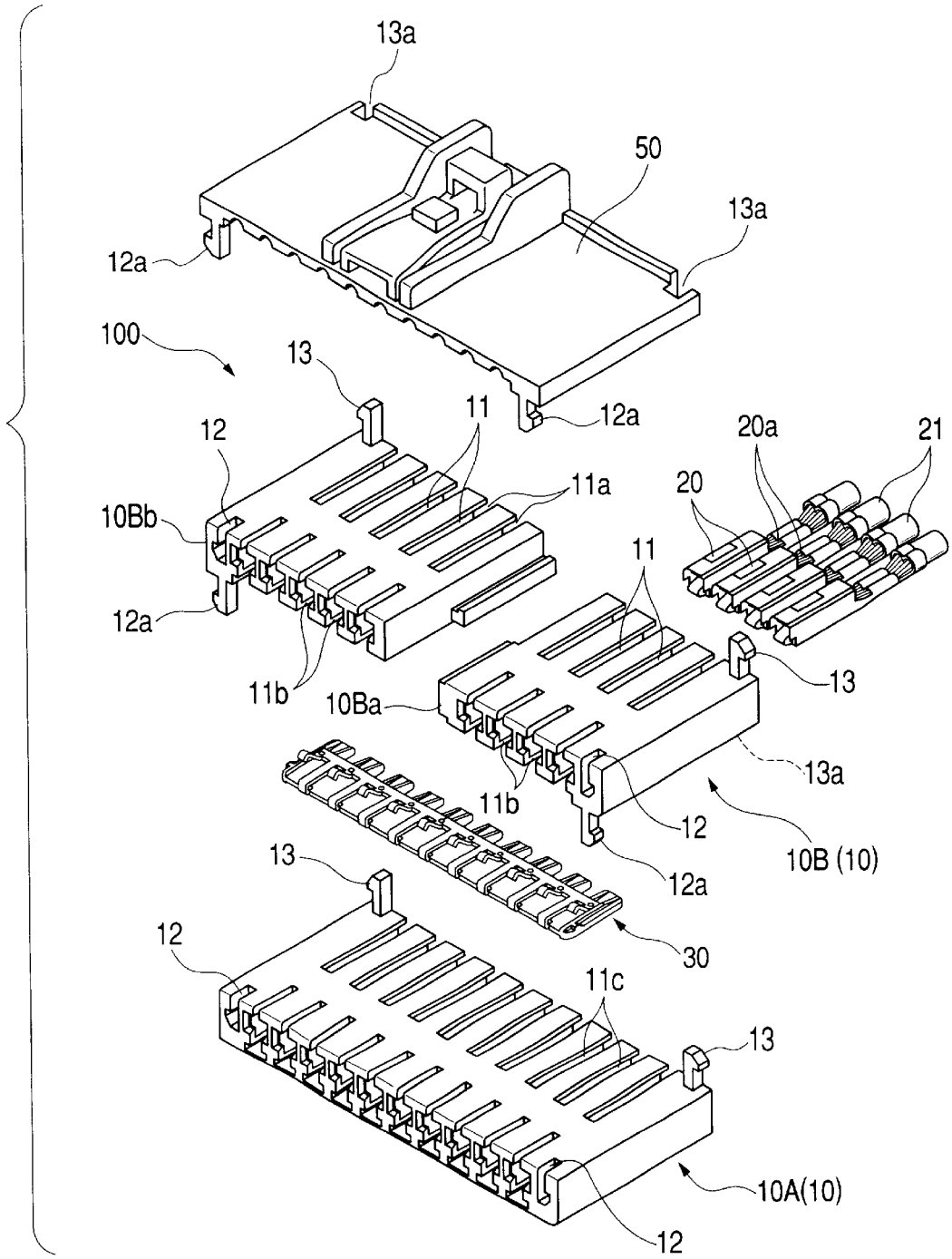
FIG. 1 is an exploded perspective view illustrating an embodiment of a joint connector using a circuit forming element according to the invention.

FIG. 1 is an exploded perspective view illustrating a joint connector 100 that has housings 10, terminals 20, a circuit forming element 30, and a cover 50. Each of the housings 10 is formed so that terminal accommodating portions each for accommodating a plurality of terminals 20 are juxtaposed with each other. Each of these terminal accommodating portions 11 has insertion ports 11*a*, which respectively correspond to the terminals 20 and that are provided in a rear-surface-side portion of a corresponding one of the housings 10 (at a side illustrated in this figure as the rear side thereof), and also has insertion openings 11*b*, each of which is provided in a front-surface-side portion thereof (at a side illustrated in this figure as being near to a viewer of this figure) and used for inserting a mate terminal 220 (to be described later) thereinto. Each of the terminals 20 is adapted so that the front end portion thereof is inserted into a corresponding one of the terminal accommodating portion 11 from an insertion port 11*a* while this terminal 20 is in a state in which a wire 21 is connected to the rear end portion thereof.

Figure 2:
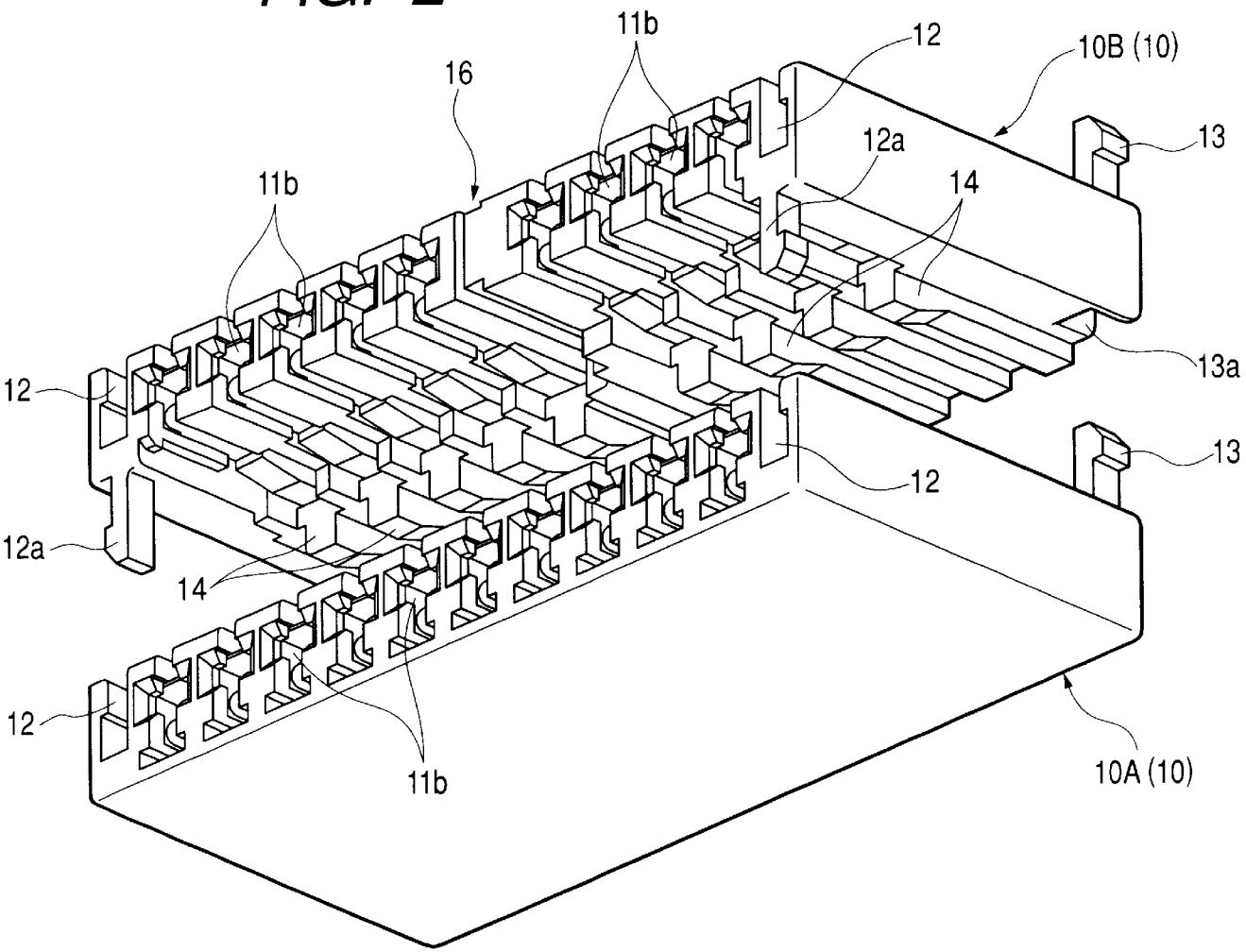
FIG. 2 is a perspective view illustrating the embodiment of a joint connector that employs the circuit forming element according to the invention and that is in a state in which housings are not stacked yet.
Figure 3:
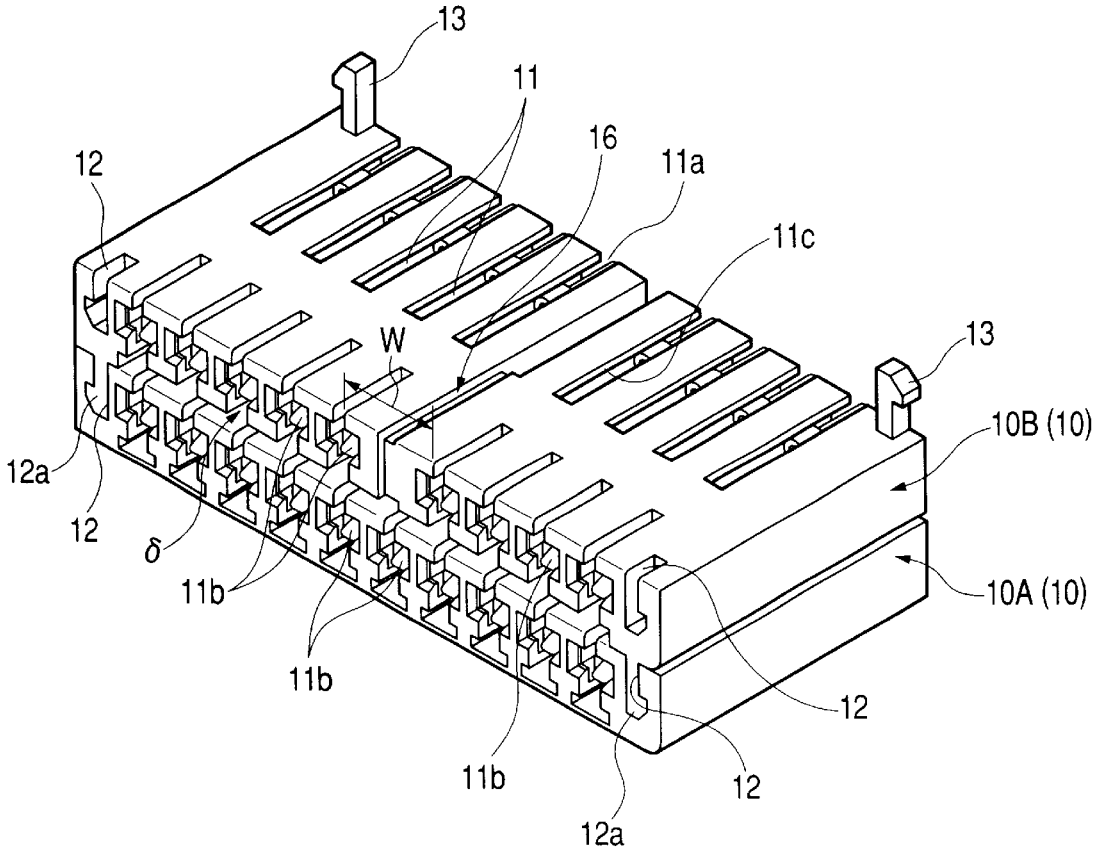
FIG. 3 is a perspective view illustrating the embodiment of a joint connector that employs the circuit forming element according to the invention and that is in a state in which the housings are stacked.

As shown in a perspective view of FIG. 2 illustrating a state in which the housings 10 are not stacked yet, first engaging concave portions 12 are formed in both side parts of the front-side portion of the top surface of each of the housings 10, while first engaging convex portions 13 are formed in both side parts of the rear-side portion of the top surface thereof. On the other hand, second engaging convex portions 12*a* are formed in both side parts of the front-side portion of the bottom surface of each of the housings 10, while second engaging concave portions 13*a* are formed in both side parts of the rear-side portion of the bottom surface thereof. Furthermore, the first engaging concave portion 12 and the first engaging convex portion 13 of one of the housings 10, which is shown as being placed in a lower part of this figure, are respectively fitted to the second engaging convex portion 12*a* and the second engaging concave portion 13*a* of the other housing 10, which is shown as being placed in an upper part of this figure. Thus, as shown in a perspective view of FIG. 3 illustrating a state in which the housings 10 are stacked, a plurality of housings 10 can be stacked. Incidentally, in this embodiment, the second engaging concave portions 12*a* and 12*a* and the second engaging concave portions 13*a* and 13*a* are not provided in the housing 10 placed in the bottom layer.

Further, the arrangement pitch of the terminal accommodating portions 11 are set to be equal to one another among the housings 10. When a plurality of housings 10 are stacked, the insertion port 11*a* and the insertion hole 11*b* of the terminal accommodating portion 11 to be formed in each of the stacked housings 10 are adjusted in an upward or downward direction to the port 11*a* and the hole 11*b* of the upper or lower one of the directly stacked housings 10.

Figure 4:
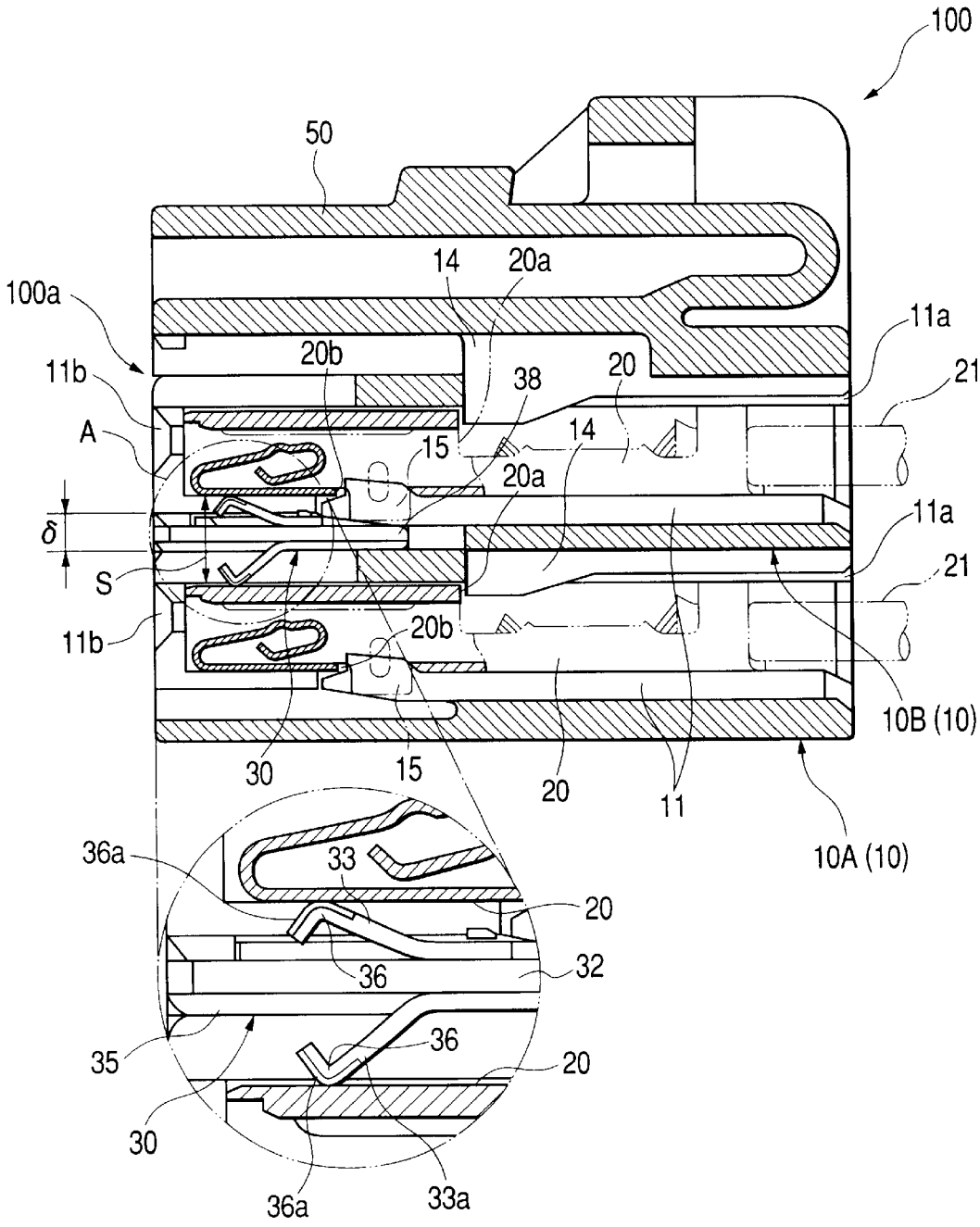
FIG. 4 is a longitudinally sectional view illustrating the embodiment of a joint connector that employs the circuit forming element according to the invention.
Figure 5:
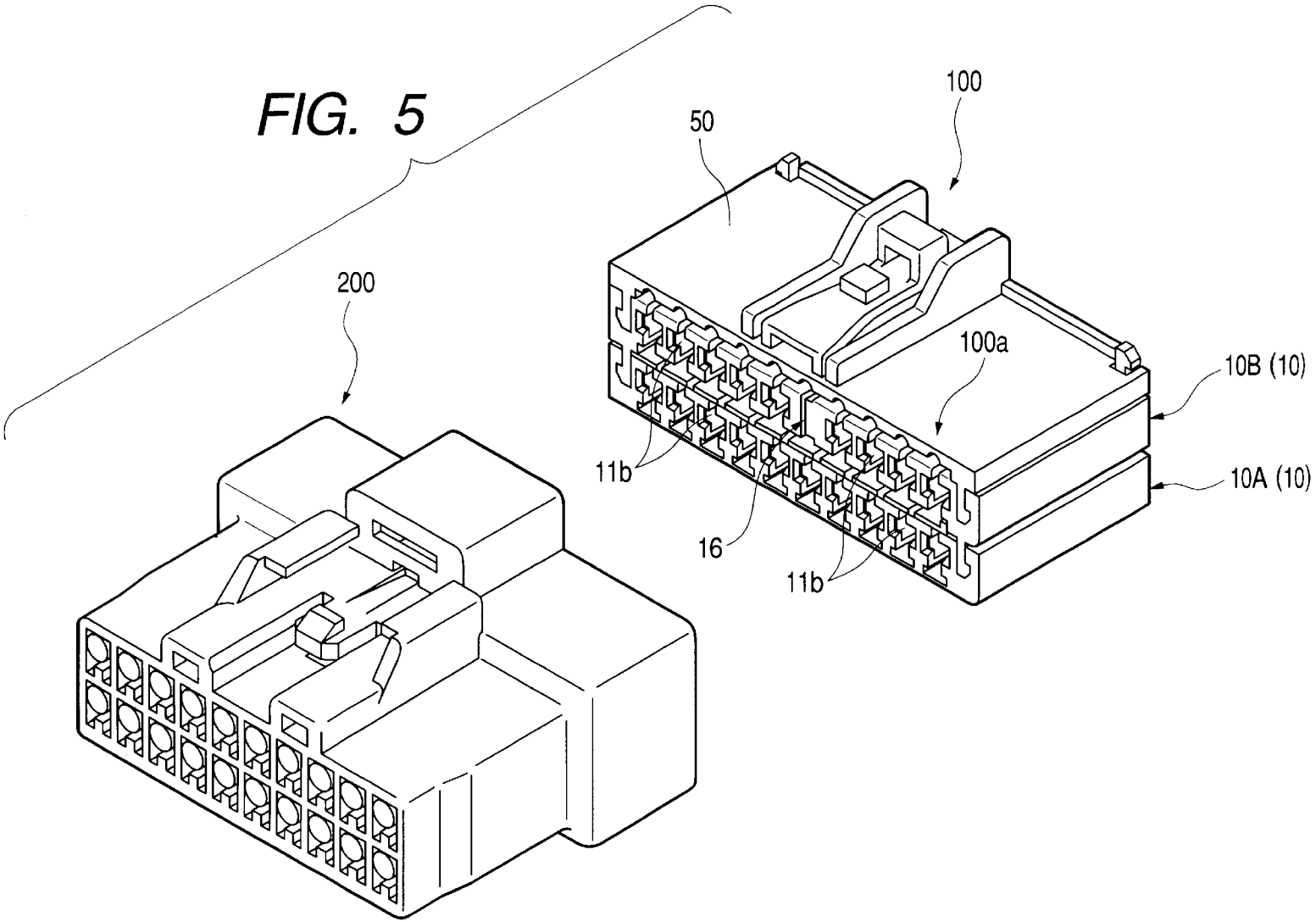
FIG. 5 is a perspective view illustrating a joint connector, which employs the circuit forming element according to the invention, and a mate connector to be coupled to this joint connector.

FIG. 4 shows a sectional view illustrating a state in which two housings 10 are stacked. A locking protrusion 14 is provided on the bottom surface of the upper housing 10 stacked on the other housing 10. As illustrated in FIG. 2, these locking protrusions 14 are respectively inserted into the terminal accommodating portions 11 of the housing 10 serving as a lower layer, on which the housing 10 serving as an upper layer is stacked, from upper crevasses 11*c* of these terminal accommodating portions 11. On the other hand, locking concave portions 20*a*, each of which is caught by the locking protrusion 14 in a withdrawal preventing direction during accommodated in the terminal accommodating portion 11, are formed at the terminals 20, respectively.

Further, as illustrated in FIG. 4, a lance 15 adapted to be engaged with the engaging portion 20*b* of the terminal 20 to thereby prevent this terminal 20 from slipping off therefrom is provided at a lower part of the terminal accommodating portion 11. This lance 15 and the locking protrusion 14 compose a double locking structure of each of the terminals 20.

Furthermore, as illustrated in FIG. 1, a cover 40 is attached to the top end portion of the housings 10 and 10 that are upwardly or downwardly stacked as shown in FIG. 3. The second engaging convex portions 12*a* and 12*a* and the second engaging concave portions 13*a* and 13*a* are formed on the bottom surface of this cover 40. These portions are respectively fitted into the first engaging concave portions 12 and 12 and the first engaging convex portions 13 and 13 of the housing 10 serving as the top layer of the stacked housings 10.

The aforementioned joint connector 100 is configured by stacking the housings 10 and 10 and the cover 50. As illustrated in a perspective view of FIG. 5, the front-surface-side end portion of this joint connector 100 is formed as a fitting portion 100*a* to be fitted into a mate connector 200. Therefore, ends of insertion openings 11*b* of the terminal accommodating portions 11 are arranged on an end surface of this fitting portion 100*a*.

As illustrated in FIG. 1, the stacked housings 10 and 10 are configured so that a lower layer is constructed as an integrated type housing 10A, and that an upper layer is constructed as a split type housing 10B. The split type housing 10B is split into two housing parts, that is, a left-hand-side part and a right-hand-side part so that a plurality of terminals 20, that is, terminal accommodating portions 11 to be accommodated therein are divided into the appropriate number of parts. The housing parts 10B*a* and 10B*b* obtained by the division are integrated by being disengageably connected to each other through an engaging/disengaging portion 16.

Thus, in the split type housing 10B, a plurality of terminals 20 can be divided into the appropriate number of housing parts. In the case that groups of wires to be connected to terminals are laid from different directions, the groups of wires are preliminarily connected to the housings 10B*a* and 10B*b*, which are obtained by the division. Thereafter, when these housing parts 10B*a* and 10B*b* obtained by the division are stacked on a stationary type housing 10A, the housing parts 10B*a* and 10B*b* are connected to each other as one unit. This facilitates wire connecting work.

As illustrated in FIG. 3, the occupied width W of the engaging/disengaging portion 16 is set in such a manner as to correspond to the pitch of the terminal accommodating portions 11. This engaging/disengaging portion 16 has a position adjustment function of adjusting the arranging pitch of the terminal accommodating portions 11 other than this engaging/disengaging portion 16 of the upper housing 10A to that of the terminal accommodating portions 11 of the lower housing 10A.

Thus, the engaging/disengaging portion 16 has the position adjustment function, so that the terminals 20 accommodated in the stacked housings 10A and 10B other than the engaging/disengaging portion 16 are placed correspondingly to a stacking direction. Consequently, circuit construction can be accurately performed by specifically setting the combination of the stacking directions of housings of a circuit to be constructed by inserting the circuit forming element 30 therebetween.

As illustrated in FIG. 4, a gap δ, from which the circuit forming element 30 is inserted, is formed in a front-surface-side part between the stacked portions of the housings 10 and 10. Further, the circuit forming elements 30 inserted from this gap δ are in contact with and electrically conducted between upper and lower rows of the terminals 20, which are respectively accommodated in the housings 10 and 10. Incidentally, the detail structure of this circuit forming element 30 will be described later with reference to FIGS. 7 to 10.

Figure 6:
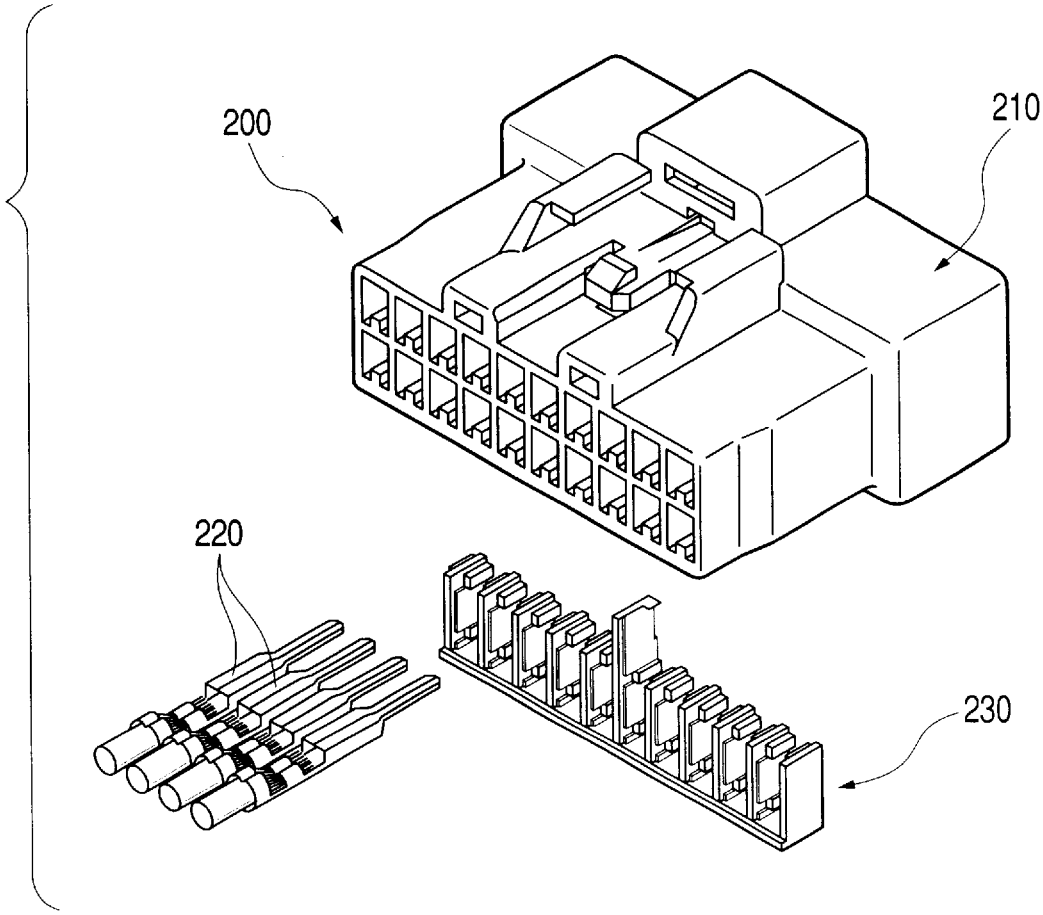
FIG. 6 is an exploded perspective view illustrating amate connector to be connected to the joint connector using the circuit forming element according to the invention.

On the other hand, as illustrated in FIG. 6, the mate connector 200 nearly comprises a housing 210, which covers and is fitted onto the fitting portion 100*a* of the joint connector 100, and a plurality of mate terminals 220 to be accommodated in this housing 210, and a spacer 230 that is placed in this housing 210 and that holds the mate terminals 220.

Further, the mate terminals 220 are inserted from the insertion openings 11*b* of the joint connector 100 by inserting the mate connector 200 into the fitting portion 100*a* of the joint connector 100. Then, each of the mate terminals 220 are connected to a corresponding one of the terminals 20.

Figure 7:
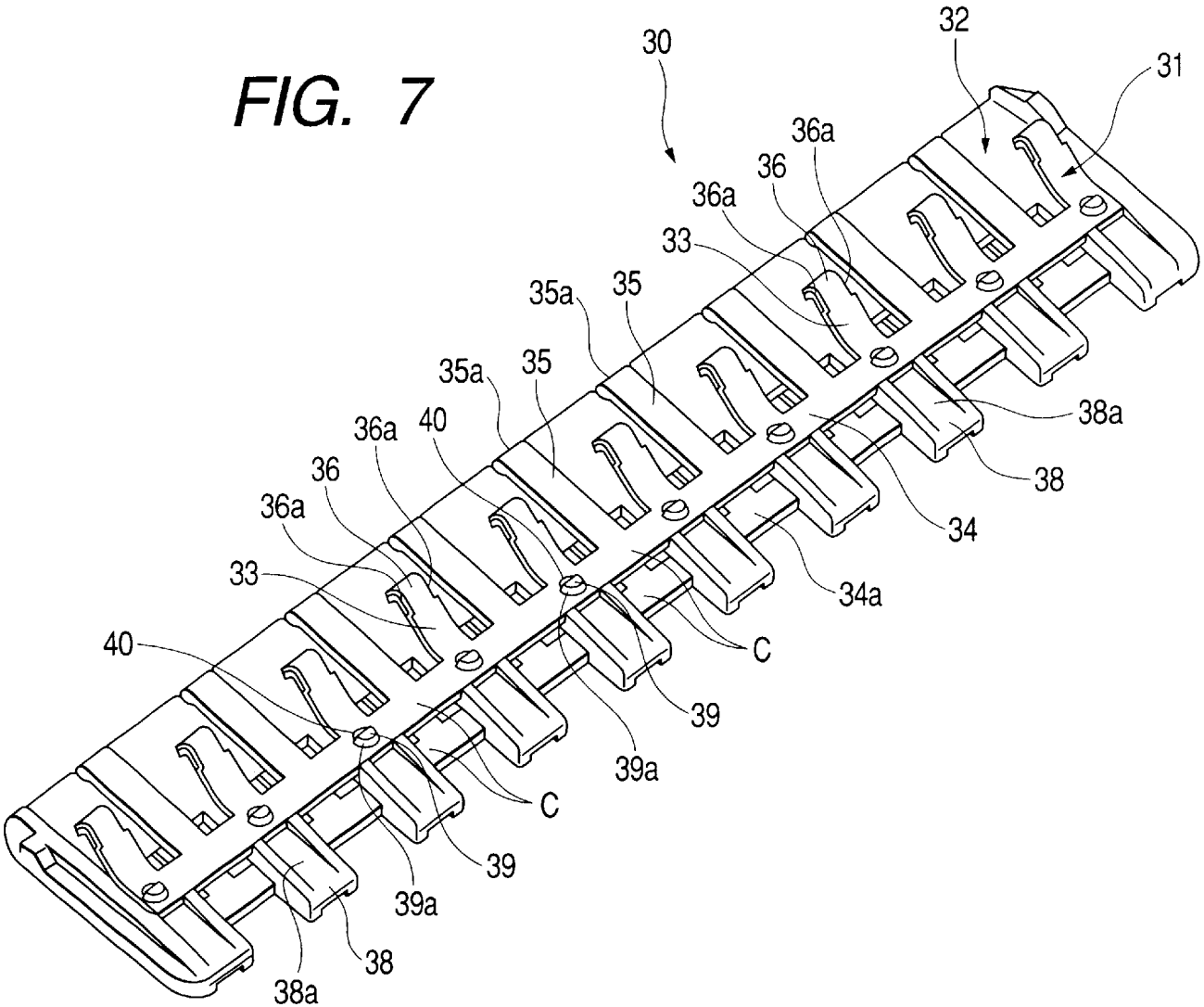
FIG. 7 is an enlarged perspective view illustrating an embodiment of the circuit forming element according to the invention.
Figure 8:
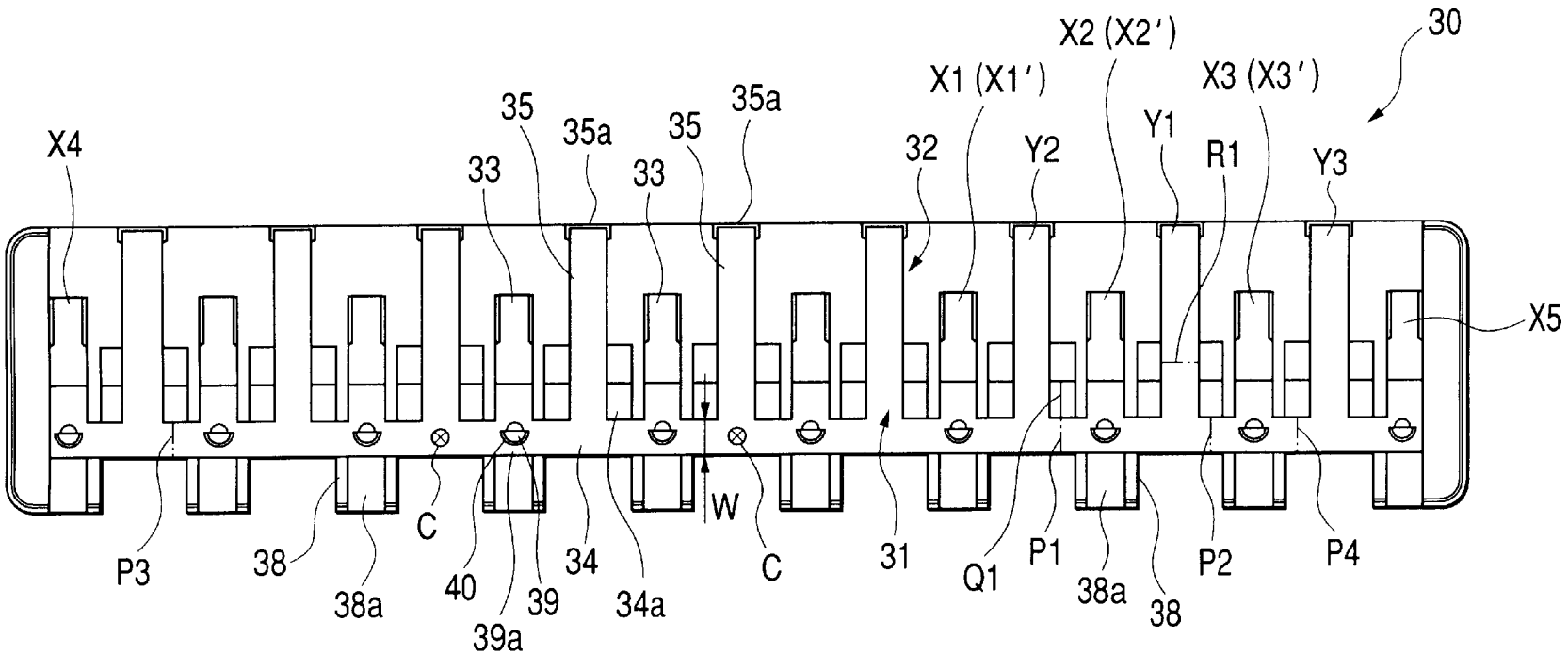
FIG. 8 is an enlarged plan view illustrating the embodiment of the circuit forming element according to the invention.
Figure 9:
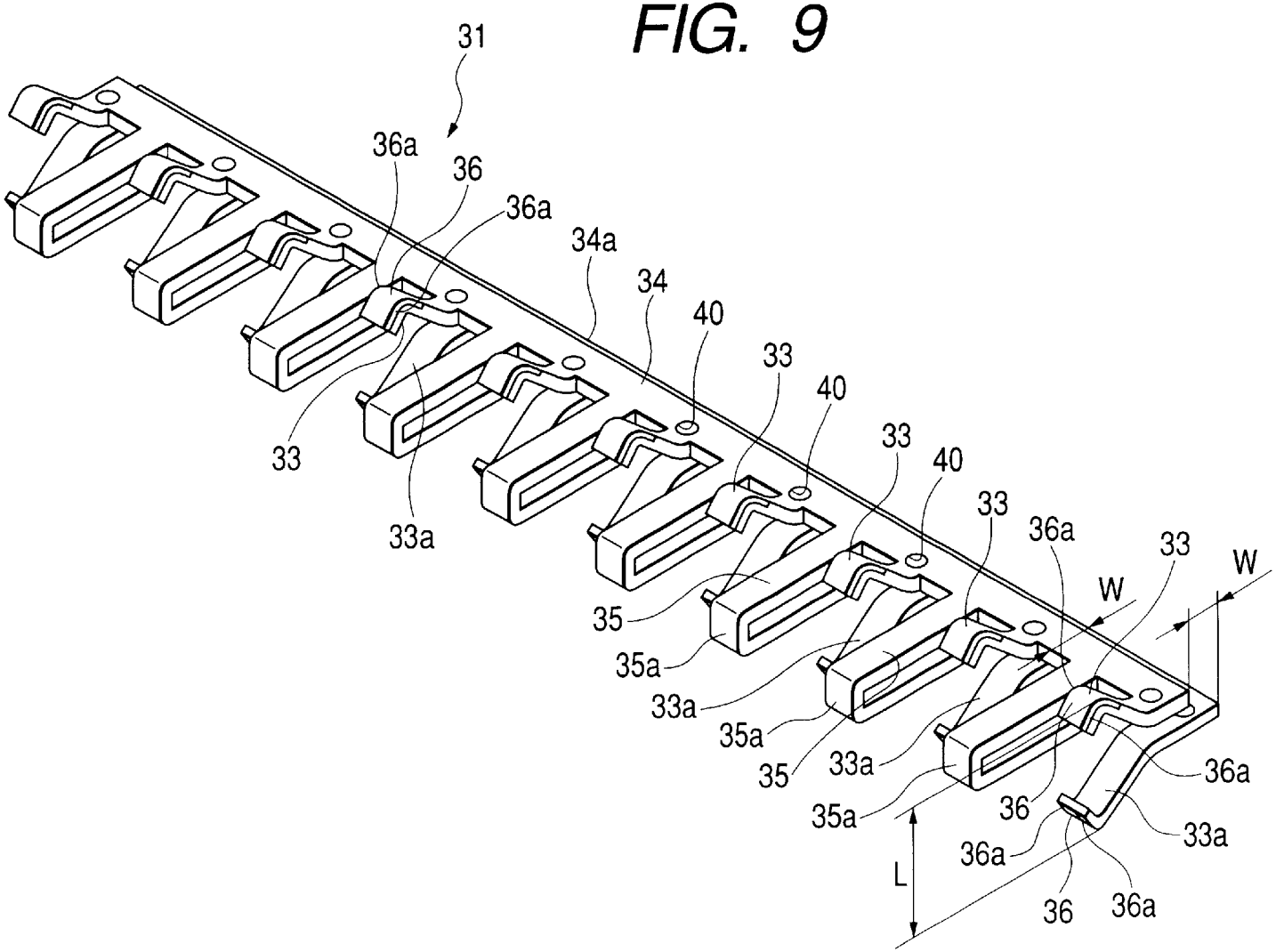
FIG. 9 is an enlarged perspective view illustrating a bus bar of the embodiment of the circuit forming element according to the invention.
Figure 10:
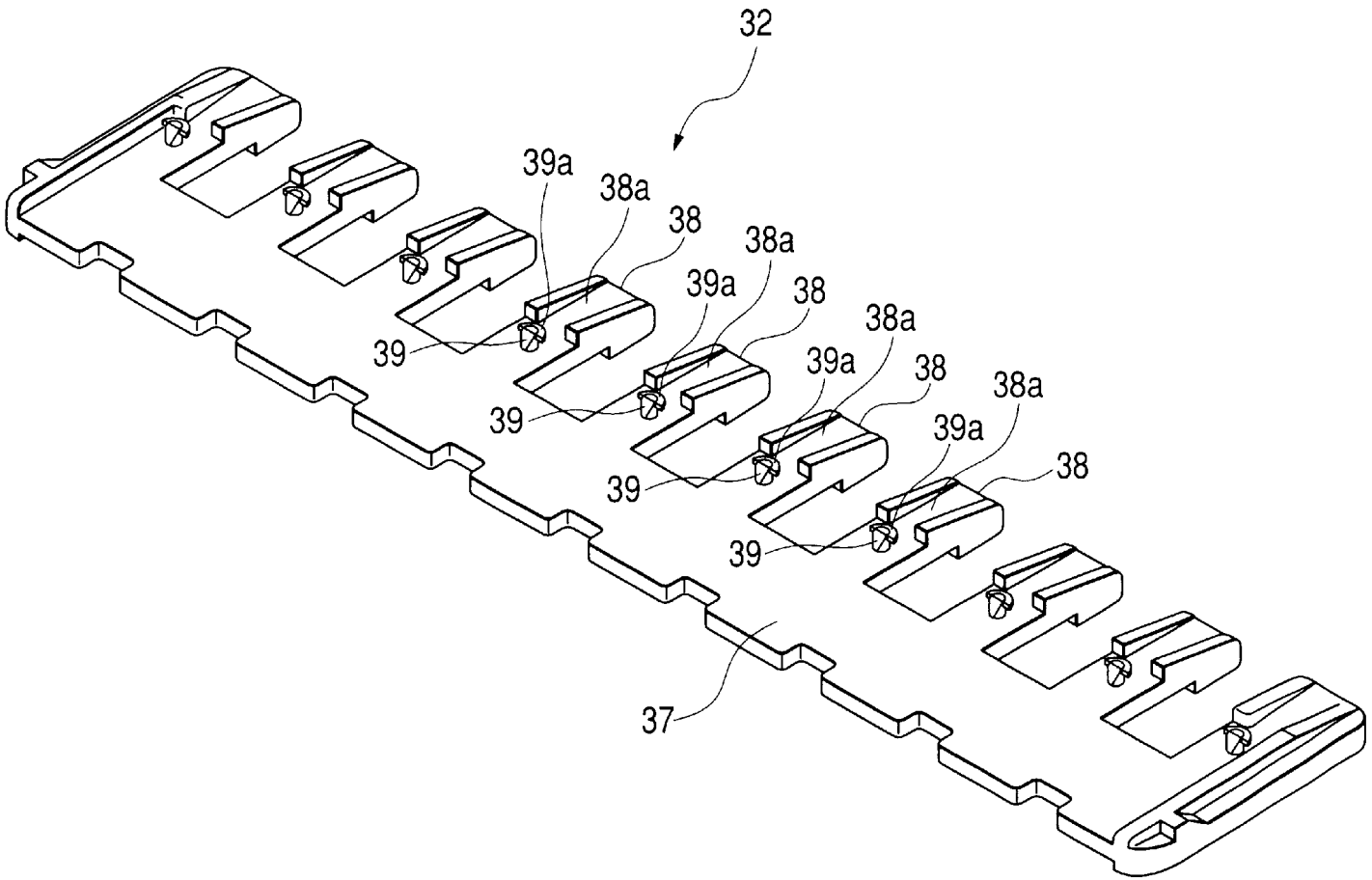
FIG. 10 is a perspective view illustrating a bus bar fixing member of the embodiment of the circuit forming element according to the invention.

FIGS. 7 to 10 illustrate the circuit forming element 30. FIG. 7 is a perspective view illustrating the entirety thereof. FIG. 8 is a plan view thereof. FIG. 9 is a perspective view illustrating a bus bar composing the circuit forming element. FIG. 10 is a perspective view illustrating a bus bar fixing member composing the circuit forming element.

As illustrated in FIG. 4, the circuit forming element 30 has a function of arbitrarily selecting the opposed terminals 20 of the housings 10 adjoining each other in the stacking direction and the juxtaposed terminals 20 of the same housing 10 and electrically conducting the selected terminals 20 to each other during the state in which the circuit forming element 30 is inserted into the gap δ provided between the stacked housings 10. As shown in FIGS. 7 and 8, this circuit forming element 30 is constructed by integrally coupling a bus bar 31, which is constituted by an electrically conductive member made of good electrically conductive metal, to a holder 32 serving as a bus bar fixing member, which supports this bus bar 31 and is constituted by an insulating member made of a synthetic resin.

As illustrated in FIG. 9, the bus bar 31 comprises pairs of terminal contact pieces 33 and 33*a*, each pair of which is in contact with the opposed terminals 20 of the stacked housings 10, and a pair of connecting base portions 34 and 34*a* each integrally connecting base-side parts of a corresponding one of sets of the terminal contact pieces 33 and the terminal contact pieces 33*a*, each set of which is placed on the same side, and also comprises connecting pieces 35 for connecting the corresponding pair of connecting base portions 34 and 34*a*.

A plurality of pairs of the terminal contact pieces 33 and 33*a* are provided so that the number of the pairs of the terminal contact pieces is equal to the number of the terminals 20 accommodated in the housing 10. The terminal contact pieces 33 and 33*a* of each of the pairs are outwardly projected and bent so that the distance L between the terminal contact pieces 33 and 33*a* thereof is wider than the interval S between the opposed terminals 20 of the stacked housings 10. Thus, the bent outer part of each of the terminal contact pieces 33 and 33*a* serves as a contact portion 36 that is in contact with the terminal 20 with a suitable elastic force. As shown in an enlarged view of a portion A in FIG. 4, chamfered portions 36*a* are provided on both sides of each of the contact portions 36.

As illustrated in FIG. 8, each of the pair of connecting base portions 34 and 34*a* is formed like a strip of a predetermined width W. The connecting base portions 34 and 34*a* are placed by being displaced (by a displacement amount W) from each other in opposed directions, that is, displaced in frontward and backward directions so that both the connecting base portions 34 and 34*a* do not overlap each other in a projection plane extending in an upward or downward direction, as viewed in this figure.

As shown in FIG. 8, a plurality of the connecting pieces 35 are disposed in such a way as to be placed between the pairs of terminal contact pieces 33 and 33*a*. Each of the connecting pieces 35 extends from the one 34 of the connecting base portions along the surface of the holder 32 and is then folded back at the front edge of this holder 32 through a U-shaped bending portion 35*a* and leads to the other connecting base portion 34*a* along the back surface thereof. Therefore, the U-shaped bending portion 5*a* is placed at the front side of the holder 32. When the circuit forming element 30 is inserted into the gap δ provided between the stacked housings 10, the U-shaped bending portion 35*a* is exposed toward the fitting portion 100*a* of the joint connector 100.

On the other hand, as illustrated in FIG. 10, the holder 32 comprises a base portion 37 extended in a direction, in which the terminal contact pieces 33 and 33*a* are arranged, and a plurality of lance-return regulating portions 38 are protruded from this base portion 37 like comb teeth correspondingly to places at which the terminal contact pieces 33 and 33*a* are located. As illustrated in FIG. 4, each of these lance-return regulating portions 38 is adapted to get under a lance 15 when the circuit forming element 30 is inserted into the gap δ provided between the stacked housings 10, and to push this lance 15 in the withdrawal preventing direction, that is, to push the lance 15 upwardly, as viewed in this figure. In this embodiment, as illustrated in FIG. 10, a concave portion 38*a* for adjusting an amount, by which the lance 15 is pushed up, is formed in the top surface part of each of the lance-return regulating portions 38. As long as the amount, by which the lance 15 is pushed up, can suitably be set, such concave portions 38*a* are not always necessary. Thus, the top surface of each of the lance-return regulating portions 38 maybe formed as a flat surface.

On the top and back surfaces of each of the lance-return regulating portions 38, protrusions 39 are projected from places at which the connecting base portions 34 and 34*a* are disposed. Moreover, a circular hole 40 serving as an opening is formed in each of T-intersections between the connecting base portions 34 and 34*a* and the terminal contact pieces 33 and 33*a*, that is, in each of the proximal ends of the terminal contact pieces 33 and 33*a*. Further, the bus bar 31 and the holder 32 are integrally coupled to each other by fitting each of these circular holes 40 around a corresponding one of the protrusions 39.

Figure 11:
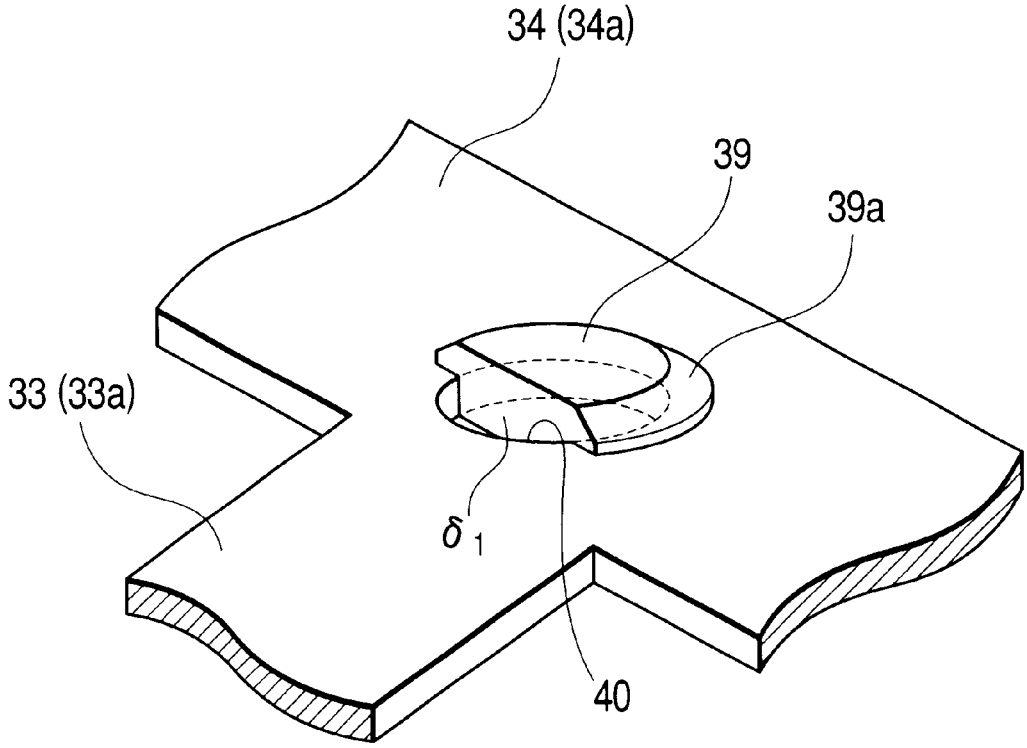
FIG. 11 is a perspective view illustrating the connection portion between the bus bar and the bus bar fixing member of the embodiment of the circuit forming element according to the invention.
Figure 12A:
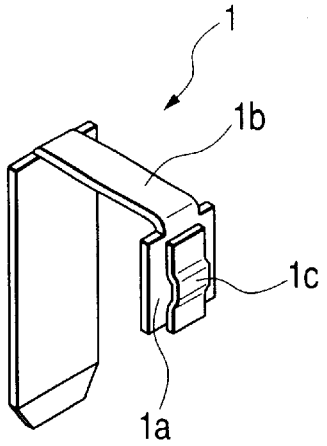
FIGS. 12A and 12B are perspective views each illustrating a conventional circuit forming element.
Figure 12B:
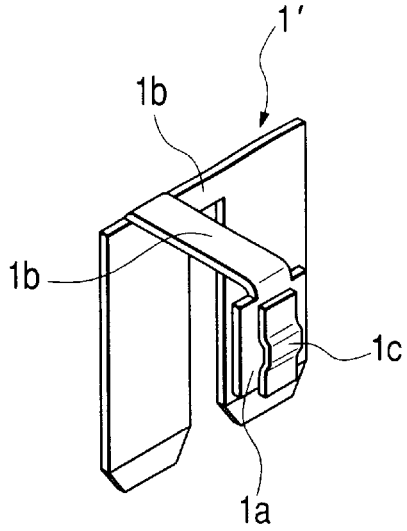
Figure 13:
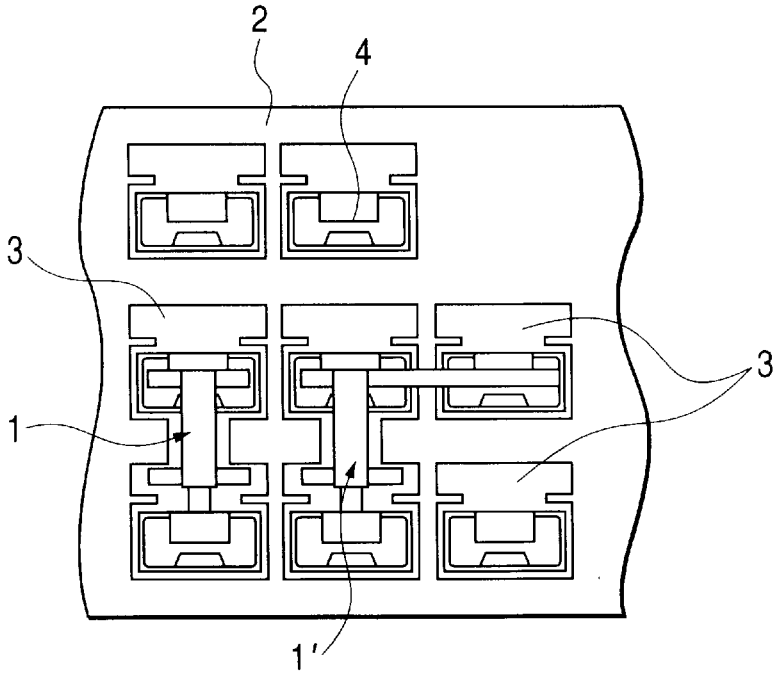
FIG. 13 is a front view showing a joint connector and illustrating a state in which the conventional circuit forming elements are attached to the joint connector.

At that time, each of the protrusions 39 is formed in such a way as to have a semicircular section, so that a partial gap δ1 is formed between this protrusion 39 and the inner circumferential surface of the circular hole 40, as illustrated in an enlarged perspective view of FIG. 11. Moreover, a withdrawal preventing flange portion 39*a* is provided at the top portion of each of the protrusions 39. Furthermore, when each of the circular holes 40 is fitted around a corresponding one of the protrusions 39, the circular hole 40 is fitted therearound by simultaneously deforming the flange portion 39*a* by means of the inner circumferential portion of the circular hole 40.

The circuit forming element 30 constructed in this manner has pairs of terminal contact pieces 33 and 33*a*. The terminal contact pieces 33 of one of two kinds to be placed on a same side are electrically conducted to one another through the connecting base portion 34, while the terminal contact pieces 33*a* of the other kind to be placed on a same side are electrically conducted to one another through the connecting base portion 34*a*. Further, the connecting base portions 34 and 34*a* are electrically conducted to each other through the connecting piece 35. Consequently, all the terminal contact pieces 33 and 34*a* are in an electrically conducted state.

During this state, the connecting base portions 34 and 34*a* and the connecting piece 35 are cut at appropriate cutting portions to thereby enable both the arbitrary setting of the electrically conducting relation among a plurality of terminal contact pieces 33 and 33*a*, and the construction of an arbitrary circuit between rows of terminals 20 accommodated in the stacked housings 10. At that time, the cutting portions are provided in the vicinity of a connecting portion C at which the connecting base portions 34 and 34*a* and the connecting piece 35 are assembled into a T-shaped portion.

Hereinafter, an example of arbitrary circuit construction to be performed by using the circuit forming element 30 is described with reference to FIG. 8. In this case, it is assumed that let P1, P2, . . . denote the cutting portions at which one 34 of the connecting base portions 34 and 34*a* is cut, that let Q1, Q2, . . . designate the cutting portions at which the other connecting base portion 34*a* is cut, that let R1, R2, . . . denote the cutting portions at which the connecting piece 35 is cut, that let X1, X2, . . . designate specific terminal contact pieces 33, that let X1', X2', . . . terminal contact pieces 33*a* (not shown) respectively facing the terminal contact pieces X1, X2, . . . , and that let Y1, Y2, . . . denote the specific connecting pieces 35.

That is, in the case that the connecting base portions 34 and 34*a* are respectively cut at places P1 and Q1 between the terminal contact pieces X1 and X2, as illustrated in FIG. 8, the terminal contact pieces X1 and X1' are not electrically conducted to the terminal contact pieces X2 and X2'.

Moreover, the terminal contact pieces X1 and X3 are electrically conducted to each other through the connecting pieces Y2 and Y3 by cutting the connecting base portion 34 at places P1 and P2, and by cutting the connecting piece Y1 at a place R1. This enables so-called a skip connection, which is performed by skipping the terminal contact piece X2. This skip connection is enabled not only in a way, in which one terminal contact piece 33 is skipped, but in other various ways. For instance, only terminal contact pieces X4 and X5 provided at both end parts of the connecting base portion 34 are electrically conducted to each other through the connecting pieces Y3 and Y4 by cutting the connecting base portion 34 at places P3 and P4. Needless to say, when so-called the skip connection of the terminal contact pieces X4 and X5 is performed, the connecting pieces 35 other than the connecting pieces Y3 and Y4 are cut off.

Furthermore, in addition to such combinations of the cutting portions, various kinds of combinations of the cutting portions, at which the connecting base portions 34 and 34*a* and the connecting pieces 35 are cut, are set thereby to become able to electrically conduct the terminal contact pieces 33 and 33*a* opposed to each other and thereby to become able to arbitrarily select one of the terminal contact pieces 33 placed on a same side and one of the terminal contact pieces 33*a* placed on a same side and electrically conduct the selected terminal contact pieces 33 and 33*a* to each other.

With the aforementioned configuration, in a joint connector 100 employing the circuit forming element 30 of this embodiment, the housings 10, in each of which a plurality of the terminals 20 are accommodated in the juxtaposed terminal accommodating portions 11, are stacked. Then, the circuit forming element 30 is attached thereto by being inserted into the gap δ provided between the stacked housings 10.

This circuit forming element 30 is constructed by integrally connecting the bus bar 31 and the holder 32 to each other. The bus bar 31 comprises pairs of the terminal contact pieces 33 and 33*a*, a pair of the connecting base portions 34 and 34*a*, and the connecting pieces 35. This circuit forming element 30 enables the connection of the terminals 20 of the housings 10 adjoining each other in the stacking direction, and the arbitrary selection and connection of the terminals 20 to be connected to each other by employing the circuit structure of this circuit forming element 30.

Therefore, the joint connector 100 has a simple structure in which the circuit forming element 30 formed separately from the terminals 20 is inserted into the gap δ. The bus bar 31 facilitates the connection between the stacked terminals 20. A desired circuit can easily be obtained by utilizing the circuit structure of this bus bar 31. This realizes broad diversification in formation of circuits.

Further, the bus bar 31 capable of constructing an arbitrary circuit in this way is enabled by being coupled to the holder 32 to hold a contact state, in which the bus bar 31 is in contact with the terminal 20, without excessively increasing the strength of the bus bar 31 itself. The entire circuit forming element 30 is constructed as one compact component, and thus becomes easy to handle.

The joint connector 100 has a fitting portion 100*a* at the front surface side thereof, and is adapted so that a mate connector 200 is inserted into this fitting portion 100*a*. Mate terminals 220 are inserted from the insertion openings 11*b* of the housings 10 thereinto and connected to the terminals 20, respectively, by inserting the mate connector 200 thereinto. Therefore, the mate terminals 220 of the mate connector 200 serving as another wiring circuit can easily be connected to the terminals 20 by constructing an arbitrary circuit among a plurality of the terminals 20 accommodated in the stacked housings 10 and by then fitting the mate connector 200 to the fitting portion 100*a* of the joint connector 100.

Meanwhile, as illustrated in FIG. 4, in this embodiment, the locking protrusions 14 provided in the housing 10 serving as an upper layer are engaged with the locking concave portions 20*a* of the terminals 20 accommodated in the terminal accommodating portions 11 of the housing 10 serving as a lower layer when the housings 10 are stacked. Consequently, the terminals 20 can be prevented from slipping off therefrom.

Further, in addition to the locking protrusions 14, the lances 15 are provide in each of the terminal accommodating portions 11. Thus, with the double locking structure, the lances 15 are engaged with the locking portions 20*b* of the terminals 20, respectively. The engaged state of this lance 15 is held by the lance return regulating portion 38, which pushes the lance 15 and is formed in the holder 32 of the circuit forming element 30. Thus, the return of the lance 15, that is, the cancellation of the state, in which the lance 15 engages with the terminal 20, is prevented. Consequently, this terminal 20 can be more reliably prevented from slipping off therefrom.

Furthermore, in the circuit forming element 30, the bus bar 31 constituted by an electrically conductive member made of good electrically conductive metal is supported by the holder 32. Thus, the contact state, in which the bus bar 31 is in contact with the terminal 20, can be held without excessively increasing the strength of the bus bar 31 itself. Thus, poor contact can be prevented from occurring in the circuit.

Further, the bus bar 31 is adapted so that pairs of terminal contact pieces 33 and 33*a*, which are arranged in such a way as to be opposed in an upward or downward direction, come in contact with the upper and lower terminals 20 of the stacked housings 10. Among these terminal contact pieces 33 and 33*a*, a set of the terminal contact pieces 33 arranged on a same side and another set of the terminal contact pieces 33*a* arranged on a same side are connected to a pair of the connecting base portions 34 and 34*a*, respectively. Moreover, these connecting base portions 34 and 34*a* are connected to each other through the connecting piece 35. The diversification in formation of a circuit including so-called a skip connection between the terminals 20 opposed in an upward or downward direction of the stacked housings 10 and between the terminals juxtaposed in the same housing 10 can be achieved by cutting these connecting base portions 34 and 34*a* and the connecting pieces 35 at proper places.

At that time, the cutting portions, at which the connecting base portions 34 and 34*a* and the connecting piece 35 are cut, are provided in the vicinity of a connecting portion C at which these portions 34 and 34*a* and the connecting piece 35 are assembled into a T-shaped portion. Thus, the cutting portions are concentrated, so that the management of the electrically conducting relation is facilitated. Moreover, cutting blades (not shown) for cutting the connecting base portions 34 and 34*a* and the connecting piece 35 are concentrated to thereby realize a compact circuit forming element.

Further, The pair of connecting base portions 34 and 34*a* are placed by being displaced from each other in opposed directions, that is, displaced so that both the connecting base portions 34 and 34*a* do not overlap each other in a projection plane extending in a facing direction that is a cutting direction. Thus, the connecting base portions 34 and 34*a* become easy to individually cut. Consequently, operations of cutting the connecting base portions are facilitated.

Meanwhile, the terminal contact pieces 33 and 33*a* are brought into contact with the terminals 20 by elastic forces, and electrically conducted thereto. However, each of the terminal contact pieces 33 and 33*a* has a proximal end that is integrally coupled to the holder 32 through the protrusion 39 and the circular hole 40. Thus, the spring forces of the terminal contact pieces 33 and 33*a* are effectively exerted thereon, so that a contact force acting between the terminal contact piece and the terminal is ensured. Consequently, poor contact can be prevented from occurring therebetween.

At that time, the chamfered portion 36*a* is provided on each of side parts of the portions, at which the terminal contact pieces 33 and 33*a* are in contact with the terminals 20, to thereby prevent the terminals 20 from being damaged.

Furthermore, regarding the protrusion 39 and the circular hole 40, the protrusion 39 is fitted into the circular hole 40 by simultaneously forming a partial gap δ between the protrusion 39 and the inner circumferential surface of the circular hole 40. Thus, in the case that when the flange portion 39*a* of the protrusion 39 is fitted into the circular hole 40, the flange portion 39*a* is deformed, the deformed part gets into the gap δ. Consequently, an amount cut by the inner circumferential portion of the circular hole 40 away from the flange portion 39*a* is reduced. Finally, the bonding strength between the circular hole 40 and the protrusion 39, which is fixed by this flange portion 39*a* thereon, can be increased.

Further, the connecting pieces 35 of the bus bar 31 is adapted so that the U-shaped bending portion 35*a* is disposed at the front side of the holder 32, and that this U-shaped bending portion 35*a* is exposed toward the fitting portion 100*a* of the joint connector 100. Thus, a measuring terminal of a tester (not shown) can easily be brought into contact with this exposed part. Consequently, the conducting relation of the bus bar 31 can be easily and reliably checked. Moreover, because the U-shaped bending portion 35*a* is exposed toward the fitting portion 100*a* of the mate connector 200, the exposed part can be concealed.

According to the first circuit forming element of the invention, the bus bar is adapted so that each of the paired terminal contact pieces is electrically conducted to the connecting base portion, and that the connecting base portions are electrically conducted to each other through the connecting piece. Thus, this circuit forming element is in a state in which all the terminal contact pieces are electrically conducted to each other. During this state, one or both of a pair of connecting base portions are cut at appropriate places, alternatively, the connecting piece is cut. Thus, an arbitrary circuit including so-called a skip connection can be configured. Further, the bus bar capable of constructing an arbitrary circuit in this way is coupled to the bus bar fixing member, so that the contact state between the bus bar and the terminal can be held without excessively increasing the strength of the bus bar. Thus, the entire circuit forming element is constructed as one component, and thus becomes easy to handle.

The second circuit forming element of the invention obtains the following effects in addition to the effects of the first circuit forming element of the invention. That is, according to the second circuit forming element of the invention, the pair of connecting base portions are disposed by being displaced from each other so that both the connecting base portions do not overlap each other in a projection plane extending in opposed directions. Thus, when the cutting blades are inserted from opposed directions thereof, the connecting base portions are easy to individually cut. Moreover, operation of cutting the connecting base portions are facilitated.

The third circuit forming element of the invention obtains the following effects in addition to the effects of the first and second circuit forming elements of the invention. That is, according to the second circuit forming element of the invention, the proximal ends of the terminal contact pieces are integrally attached to the bus bar fixing member. Thus, the spring forces of the terminal contact pieces are effectively exerted, so that the contact force acting between the terminal contact piece and the terminal is ensured. Moreover, an occurrence of poor contact therebetween can be prevented.

The fourth circuit forming element of the invention obtains the following effects in addition to the effects of the first to third circuit forming elements of the invention. That is, according to the fourth circuit forming element of the invention, the bus bar and the bus bar fixing member are coupled to each other by fitting the protrusion, which has the flange portion, of the bus bar fixing member into the opening while the partial gap is formed between this protrusion and the inner circumferential portion of the opening of the bus bar. Thus, when the flange portion of the protrusion is deformed during the flange portion is fitted into the opening formed in the bus bar, the deformed part gets into the gap. Consequently, an amount cut by the inner circumferential portion of the opening away from the flange portion can be reduced. Finally, the bonding strength between the opening and the protrusion to be fixed thereto can be increased.

The fifth circuit forming element of the invention obtains the following effects in addition to the effects of the first to fourth circuit forming elements of the invention. That is, according to the fifth circuit forming element of the invention, the cutting portions for selectively cutting the connecting base portions and the connecting piece are provided in the vicinity of a connection portion among these connecting base portions and the connecting pieces. Thus, the cutting portions are concentrated, so that the management of the electrically conducting relation can be facilitated. Moreover, the cutting blades can be concentrated to thereby realize a compact circuit forming element.

The sixth circuit forming element of the invention obtains the following effects in addition to the effects of the first to fifth circuit forming elements of the invention. That is, according to the sixth circuit forming element of the invention, the lance-return regulating portion is provided in the bus bar fitting member. Further, the lance to be engaged in the withdrawal preventing direction of the terminal is pushed in the withdrawal preventing direction. Thus, the return of the lance, that is, the cancellation of the state, in which the lance engages with the terminal, can be prevented. Consequently, this terminal can be prevented from slipping off therefrom.

The seventh circuit forming element of the invention obtains the following effects in addition to the effects of the first to sixth circuit forming elements of the invention. That is, according to the seventh circuit forming element of the invention, the chamfered portions are provided on the side parts of the contact portion at which each of the terminal contact pieces is in contact with a corresponding one of the terminals. Thus, the terminal can be prevented from being damaged by the side part of the contact portion of the terminal contact piece.

The eighth circuit forming element of the invention obtains the following effects in addition to the effects of the first to seventh circuit forming elements of the invention. That is, according to the eighth circuit forming element of the invention, the U-shaped bending portion of the connecting piece is outwardly exposed. Thus, the measuring terminal of a tester can easily be brought into contact with this exposed part. Consequently, the conducting relation of the bus bar can be easily and reliably checked.

What is claimed is:

1. A circuit forming element comprising:

a bus bar including a plurality of pairs of terminal contact pieces, each pair of which are brought into contact respectively with the terminals opposing with each other provided in the housings adjoining to each other in the stacking direction, a pair of connecting base portions one of which integrally connects proximal ends of said terminal contact pieces disposed at one side while the other connecting base portion integrally connects proximal ends of said terminal contact pieces disposed at the other side, and connecting pieces connecting said pair of connecting base portions;

wherein said bus bar is integrally coupled to a bus bar fixing member provided with an insulating member.

2. A circuit forming element according to claim 1, wherein said pair of connecting base portions are offset with respect to each other so that the two connecting base portions do not overlap each other in a plane of projection in a direction of opposing of said connecting base portions to each other.

3. A circuit forming element according to claim 1, wherein proximal ends of said terminal contact pieces are integrally connected to said bus bar fixing member.

4. A circuit forming element according to claim 1, wherein a coupling between said bus bar and said bus bar fixing member is fixed through an opening formed in said bus bar and a protrusion having a flange portion, which is formed on said bus bar fixing member and fitted into the opening by simultaneously forming a partial gap between said protrusion and an inner circumferential portion of said opening.

5. A circuit forming element according to claim 1, wherein cutting portions are selectively formed on said bus bar in the vicinity of portions where said connecting base portion and said connecting piece are connected together.

6. A circuit forming element according to claim 1, wherein a lance for engaging the terminal in a direction to prevent the withdrawal thereof is provided in said terminal accommodating portion for accommodating said terminal, and said bus bar-fixing member has a lance-return regulating portion pressing the lance in a withdrawal prevention direction.

7. A circuit forming element according to claim 1, wherein a chamfered portion is formed at an opposite side edge of said terminal contact piece brought into contact with the terminal.

8. A circuit forming element according to claim 1, wherein a U-shaped bending portion to be folded back on a side edge of said bus bar fixing member is provided in each of said connecting pieces, and wherein said U-shaped bending portions are outwardly exposed.

* * * * *